US009174233B2

(12) United States Patent
Nabeshima et al.

(10) Patent No.: US 9,174,233 B2
(45) Date of Patent: Nov. 3, 2015

(54) APPARATUS FOR FILLING PAINT CARTRIDGES

(75) Inventors: Atsuo Nabeshima, Okazaki (JP); Shinji Tani, Miyoshi (JP); Takanobu Mori, Toyota (JP); Isamu Yamasaki, Toyota (JP); Shinichi Nakane, Toyota (JP); Koji Fukuzawa, Toyota (JP); Tomohiro Hasuike, Toyota (JP)

(73) Assignees: TOYOTA JIDOSHA KABUSHIKI KAISHA, Toyota-Shi (JP); TRINITY INDUSTRIAL CORPORATION, Toyota-Shi (JP)

( * ) Notice: Subject to any disclaimer, the term of this patent is extended or adjusted under 35 U.S.C. 154(b) by 514 days.

(21) Appl. No.: 13/503,334

(22) PCT Filed: Oct. 19, 2010

(86) PCT No.: PCT/IB2010/002828

§ 371 (c)(1),
(2), (4) Date: Aug. 15, 2012

(87) PCT Pub. No.: WO2011/048488

PCT Pub. Date: Apr. 28, 2011

(65) Prior Publication Data

US 2012/0298257 A1 Nov. 29, 2012

(30) Foreign Application Priority Data

Oct. 21, 2009 (JP) ..... 2009-242832

(51) Int. Cl.
*B05B 12/14* (2006.01)

(52) U.S. Cl.
CPC ..... *B05B 12/1463* (2013.01)

(58) Field of Classification Search
CPC ..... B05B 12/1463; B05B 15/025; B65B 2210/06
USPC ..... 141/2, 18, 21, 85, 89, 91, 104
See application file for complete search history.

(56) References Cited

U.S. PATENT DOCUMENTS 3,820,578 A 6/1974 Staba
3,981,320 A * 9/1976 Wiggins ..... 137/240

(Continued)

FOREIGN PATENT DOCUMENTS

EP 1566221 A2 8/2005
EP 2095879 A1 9/2009

(Continued)

OTHER PUBLICATIONS

International Search Report and Written Opinion of PCT/IB2010/002828 mailed Mar. 28, 2011.

(Continued)

*Primary Examiner* — Nicolas A Arnett
(74) *Attorney, Agent, or Firm* — Kenyon & Kenyon LLP

(57) ABSTRACT

A paint filling apparatus has a plurality of header portions, and one common manifold portion that is capable of supplying a cleaning liquid to each header portion. One side of each header portion is attachable to and detachable from a paint cartridge, and another side of each header portion is attachable to and detachable from the common manifold portion. Each header portion has a paint supply channel for filling a paint into the paint cartridge. The paint supply channel of each header portion is constructed of a piping member and a paint channel. An end portion of each header portion is linkable in communication with the inside of the paint cartridge, and another end portion thereof is linked in communication with a corresponding one of paint tanks that are provided separately for each of the paint colors. An intermediate portion of each paint supply channel is provided with a paint valve that controls the open-closed state of the upstream side of the paint supply channel.

4 Claims, 7 Drawing Sheets

(56) References Cited

U.S. PATENT DOCUMENTS

| | | | | |
|---|---|---|---|---|
| 4,745,011 | A | 5/1988 | Fukuta et al. | |
| 4,792,092 | A * | 12/1988 | Elberson et al. | 239/3 |
| 4,884,752 | A * | 12/1989 | Plummer | 239/691 |
| 5,072,881 | A * | 12/1991 | Taube, III | 239/8 |
| 5,197,676 | A * | 3/1993 | Konieczynski et al. | 239/690 |
| 5,255,856 | A * | 10/1993 | Ishibashi et al. | 239/691 |
| 5,271,569 | A * | 12/1993 | Konieczynski et al. | 239/690 |
| 5,309,959 | A | 5/1994 | Shaw et al. | |
| 5,676,756 | A | 10/1997 | Murate et al. | |
| 5,725,161 | A | 3/1998 | Hartle | |
| 5,788,164 | A | 8/1998 | Tomita et al. | |
| 6,010,084 | A | 1/2000 | Yoshida et al. | |
| 6,164,561 | A | 12/2000 | Yoshida et al. | |
| 6,179,217 | B1 | 1/2001 | Yoshida et al. | |
| 6,391,392 | B1 | 5/2002 | Thome et al. | |
| 6,401,768 | B2 * | 6/2002 | Lichte et al. | 141/2 |
| 6,533,861 | B1 | 3/2003 | Matsuda et al. | |
| 6,612,345 | B1 | 9/2003 | Hosoda et al. | |
| 8,006,921 | B2 | 8/2011 | Yamasaki et al. | |
| 8,016,001 | B2 | 9/2011 | Yamasaki et al. | |
| 8,042,579 | B2 * | 10/2011 | Matsumoto | 141/94 |
| 8,146,840 | B2 * | 4/2012 | Nakazono et al. | 239/690.1 |
| 8,201,585 | B2 | 6/2012 | Nomura et al. | |
| 8,225,740 | B2 | 7/2012 | Mitsui et al. | |
| 8,434,702 | B2 * | 5/2013 | Mori et al. | 239/690 |
| 2002/0043567 | A1 | 4/2002 | Provenaz et al. | |
| 2002/0046699 | A1 | 4/2002 | Congard et al. | |
| 2002/0081386 | A1 | 6/2002 | Yoshida et al. | |
| 2002/0158148 | A1 * | 10/2002 | Hosoda et al. | 239/305 |
| 2003/0234299 | A1 | 12/2003 | Hosoda et al. | |
| 2004/0020551 | A1 * | 2/2004 | Cebola et al. | 141/2 |
| 2005/0076832 | A1 | 4/2005 | Nakane | |
| 2005/0189435 | A1 | 9/2005 | Kubota et al. | |
| 2009/0108109 | A1 | 4/2009 | Mori et al. | |
| 2009/0206177 | A1 | 8/2009 | Hamamura et al. | |
| 2009/0277378 | A1 | 11/2009 | Yamauchi | |
| 2009/0277530 | A1 | 11/2009 | Nomura et al. | |
| 2010/0001099 | A1 | 1/2010 | Onda | |
| 2010/0243101 | A1 | 9/2010 | Matsumoto | |
| 2011/0020561 | A1 | 1/2011 | Tani | |
| 2012/0312414 | A1 * | 12/2012 | Nabeshima et al. | 141/2 |
| 2013/0167971 | A1 | 7/2013 | Yamauchi | |
| 2013/0320109 | A1 | 12/2013 | Yamauchi | |
| 2014/0151462 | A1 | 6/2014 | Yamauchi | |
| 2014/0166779 | A1 | 6/2014 | Yamauchi | |

FOREIGN PATENT DOCUMENTS

| | | | |
|---|---|---|---|
| JP | 61-046278 | A | 3/1986 |
| JP | 04-200664 | A | 7/1992 |
| JP | 09-234397 | A | 9/1997 |
| JP | 10-151385 | A | 6/1998 |
| JP | 2000-176328 | A | 6/2000 |
| JP | 2000-317360 | A | 11/2000 |
| JP | 2002-011396 | A | 1/2002 |
| JP | 2002-096002 | A | 4/2002 |
| JP | 2003-334484 | A | 11/2003 |
| JP | 2008-212869 | A | 9/2008 |
| JP | 2009-056382 | A | 3/2009 |
| WO | 97/34707 | A1 | 9/1997 |
| WO | 2008/065794 | A1 | 6/2008 |
| WO | 2011/048489 | A1 | 4/2011 |

OTHER PUBLICATIONS

Notice of Allowance issued Aug. 14, 2015 in U.S. Appl. No. 13/503,328.

* cited by examiner

COMPARATIVE EXAMPLE

COMPARATIVE EXAMPLE

APPARATUS FOR FILLING PAINT CARTRIDGES

This is a 371 national phase application of PCT/IB2010/002828 filed 19 Oct. 2010, claiming priority to Japanese Patent Application No. 2009-242832 filed 21 Oct. 2009, the contents of which are incorporated herein by reference.

BACKGROUND OF THE INVENTION

1. Field of Invention

The invention relates to a technology of a paint filling apparatus that fills a paint into a paint cartridge for use in an electrostatic painting machine. More concretely, the invention relates to a technology for providing an economical and compact paint filling apparatus that is used to fill a paint cartridge with a paint of a color that is arbitrarily selected from a plurality of color paints.

2. Description of Related Art

Generally, the painting of bodies of motor vehicles and the like, due to its requirement for high painting quality, employs electrostatic painting machines that are excellent in the efficiency of adhesion of paint to painting surfaces, the smoothness of paint films after the painting process, etc. A widely known example of the electrostatic painting machines is a rotary atomizing head type painting machine. The rotary atomizing head type painting machine is equipped with a rotary atomizing head for atomizing a water base paint, a plurality of paint cartridges that are filled with paints of different colors, etc. To perform painting of an object to be painted, a paint cartridge filled with a paint of a designated color is selected. Then, the paint filled in the paint cartridge is jetted out via rotary atomizing heads, so that paint particles are atomized, and accomplish the painting. When the paint in the paint cartridge runs out, the paint cartridge is attached to a paint filling apparatus, and is thereby replenished with the paint. Thus, the rotary atomizing head type painting machine becomes able to carry out the painting again.

Incidentally, in the paint filling apparatus, it is necessary that a paint arbitrary selected from a plurality of paints of different colors be filled into the paint cartridge. If a connecting portion, between the paint filling apparatus and a paint cartridge (an opening for supplying paint into the paint cartridge) is provided only at one site regardless of the color of paint, the paint loss (an amount of paint that is not filled into the paint cartridge but is discarded) increases. That is, the connecting portion is linked in communication with a selected one of paint supply sources that are provided separately for each of colors of paints, via a supply channel whose intermediate portion has a plurality of branch channels. Therefore, in a construction in which the connecting portion is provided only at one site, when a "color changing operation" regarding the paint in the paint cartridge is performed, the entire region in the supply channel from the paint supply source to the connecting portion needs to be washed, and the amount of paint remaining in the supply channel is discarded as a paint loss.

In order to reduce the paint loss, there has been proposed a technology of a paint filling apparatus equipped with a plurality of paint supply portions that correspond to individual paint colors. An example of such an apparatus will be described with reference to FIGS. 5A and 5B.

A paint filling apparatus 201 is equipped with a plurality of manifold portions (paint supply portions) 202 for individual colors of paints. Besides, each manifold portion 202 is composed of a body portion 202A, an actuator 202B provided on a lower surface of the body portion 202A, etc. The body portion 202A is provided with a plurality of electromagnetic valves (a trigger valve 203, a paint valve 204, a cleaning liquid valve 205, an air valve 206, a waste liquid valve 207, an extrusion liquid supply valve 208, an extrusion liquid discharge valve 209, etc.). These valves 203, 204, . . . , 209 are connected to intermediate portions of supply channels connected to various supply sources, such as a paint tank, a cleaning liquid tank, an extrusion liquid tank, etc., and to an intermediate portion of a discharge channel connected to a waste liquid tank, etc.

In each common manifold portion 202, an upper surface of the body portion 202A has a support end surface 202*a* that is attachable to and detachable from a lower surface of a paint cartridge 10. Via the support end surface 202*a*, the paint cartridge 10 is firmly held on the upper surface of the body portion 202A. Besides, in each common manifold portion 202, the body portion 202A is movable in up-down directions by the actuator 202B.

When the paint cartridge 10 is to be filled with a paint, the paint cartridge 10 is firstly moved in the horizontal direction (the direction of an arrow X shown in FIG. 5A) by a conveyor device 254, and is conveyed to a position over a manifold portion 202 that deals with the selected color paint. When the paint cartridge reaches the position over the manifold portion 202, the body portion 202A of the manifold portion 202 is raised (in the direction of an arrow Y) via the actuator 202B, as shown in FIG. 5B. Then, via the support end surface 202*a*, the manifold portion 202 and the paint cartridge 10 are linked. After that, via the manifold portion 202, the paint starts to be filled into the paint cartridge 10.

Incidentally, as for paint filling apparatuses equipped with paint supply portions separately for each of colors of paints, various apparatuses other than the foregoing paint filling apparatus 201 have also been proposed (see Japanese Patent Application Publication No. 2000-176328 (JP-A-2000-176328), Japanese Patent Application Publication No. 2002-96002 (JP-A-2002-96002), and Japanese Patent Application Publication No. 4-200664 (JP-A-4-200664)).

According to the paint filling apparatus equipped with paint supply portions provided separately for each of colors of paints, it is possible to reduce the amount of paint discarded (the amount of paint loss) at the time of changing colors, in comparison with a paint filling apparatus that has only one site of connection with a paint cartridge as described above. In particular, according to the technologies shown in Japanese Patent Application Publication No. 2000-176328 (JP-A-2000-176328), Japanese Patent Application Publication No. 2002-96002 (JP-A-2002-96002) or Japanese Patent Application Publication No. 4-200664 (JP-A-4-200664), it is also possible to shorten the time required for the "color changing operation" as well as reduce the amount of paint discarded (paint loss) at the time of the "color changing operation". However, as for the paint filling apparatus equipped with paint supply portions separately for individual colors of paints, since a plurality of common manifold portions are disposed separately for each of colors of paints, the paint filling apparatus as a whole becomes large in size, requiring a large space for installation. Besides, the overall cost for the paint filling apparatus is considerably high.

SUMMARY OF THE INVENTION

The invention provides a paint filling apparatus which fills a paint cartridge with a color paint selected from a plurality of paints of different colors, and which realizes a compact construction of the apparatus as a whole and reduction of the manufacturing cost while reducing the paint loss.

A first aspect of the invention relates to a paint filling apparatus that fills a paint cartridge with a paint of a color selected from a plurality of color paints. The paint filling apparatus has a plurality of header portions, and one common manifold portion that is able to supply a cleaning liquid to each of the header portions. One side of each of the header portions is attachable to and detachable from the paint cartridge, and another side of each header portion is attachable to and detachable from the common manifold portion. Each header portion is provided with a paint supply channel for filling the paint into the paint cartridge. One end portion of the paint supply channel of each header portion is linkable in communication with an inside of the paint cartridge, and another end portion of each paint supply channel is linked in communication with a corresponding one of a plurality of paint supply sources that are provided separately for each of the colors of the paints. An intermediate portion of each paint supply channel is provided with a paint valve that controls an open/closed state of an upstream side of the paint supply channel.

In the foregoing paint filling apparatus, a site of linkage in communication of the paint supply channel of each header portion with respect to the inside of the paint cartridge may be provided with an open-close valve that controls the open-closed state of a downstream side of the paint supply channel, and a site of attachment and detachment of the common manifold portion with respect to each header portion may be provided with a trigger valve. Furthermore, the trigger valve may become engaged with the open-close valve of a selected one of the header portions as the selected header portion and the common manifold portion are linked, and the open-close valve may perform opening and closing actions in coordination with actions of the trigger valve.

In the foregoing paint filling apparatus, within each header portion, a first branch channel and a second branch channel may be provided near the site of linkage in communication between the paint supply channel and the inside of the paint cartridge. Furthermore, within the common manifold portion, a cleaning liquid supply channel that supplies a cleaning liquid for cleaning the site of linkage in communication, and a waste liquid discharge channel for discharging a post-cleaning waste liquid to an outside of the paint filling apparatus may be provided. One end portion of the cleaning liquid supply channel may be linkable in communication with the first branch channel provided in each header portion, and another end portion of the cleaning liquid supply channel may be linked in communication with the cleaning liquid supply source. Besides, an intermediate portion of the cleaning liquid supply channel may be provided with a cleaning liquid valve that controls the open-closed state of the cleaning liquid supply channel. One end portion of the waste liquid discharged channel may be linkable in communication with the second branch channel provided in each header portion, and another end portion of the waste liquid discharge channel may be linked in communication with a waste liquid tank. An intermediate portion of the waste liquid discharge portion may be provided with a waste liquid valve that controls the open-closed state of the waste liquid discharge channel.

In the foregoing construction, among the plurality of header portions, the header portion corresponding to the paint of the selected color may be disposed above the common manifold portion, and the paint cartridge may be disposed above the header portion that corresponds to the paint of the selected color. The common manifold portion may have an elongation device capable of elongation in an up-down direction. The elongation device may elongate the common manifold portion upward, and may interlink the common manifold portion, the paint cartridge and the header portion that corresponds to the paint of the selected color.

According to the invention, it is possible to provide a paint filling apparatus which fills a paint cartridge with the paint of a color selected from a plurality of paints, and which allows a reduction of the paint loss, and achieves a compact construction of the apparatus as a whole, and a reduction of the manufacturing cost.

BRIEF DESCRIPTION OF THE DRAWINGS

The foregoing and further objects, features and advantages of the invention will become apparent from the following description of exemplary embodiments with reference to the accompanying drawings, wherein like numerals are used to represent like elements and wherein:

FIG. 4A is a perspective view showing an overall construction that the paint filling apparatus has immediately after a paint cartridge is set, and FIG. 4B is a perspective view showing an overall construction that the paint filling apparatus has immediately after the paint cartridge is filled with paint; FIG. 5A is a perspective view showing an overall construction that the paint filling apparatus has immediately after a paint cartridge is set, and FIG. 5B is a perspective view showing an overall construction that the paint filling apparatus has immediately after the paint cartridge is filled with paint.

DETAILED DESCRIPTION OF EMBODIMENTS

Figure 1:
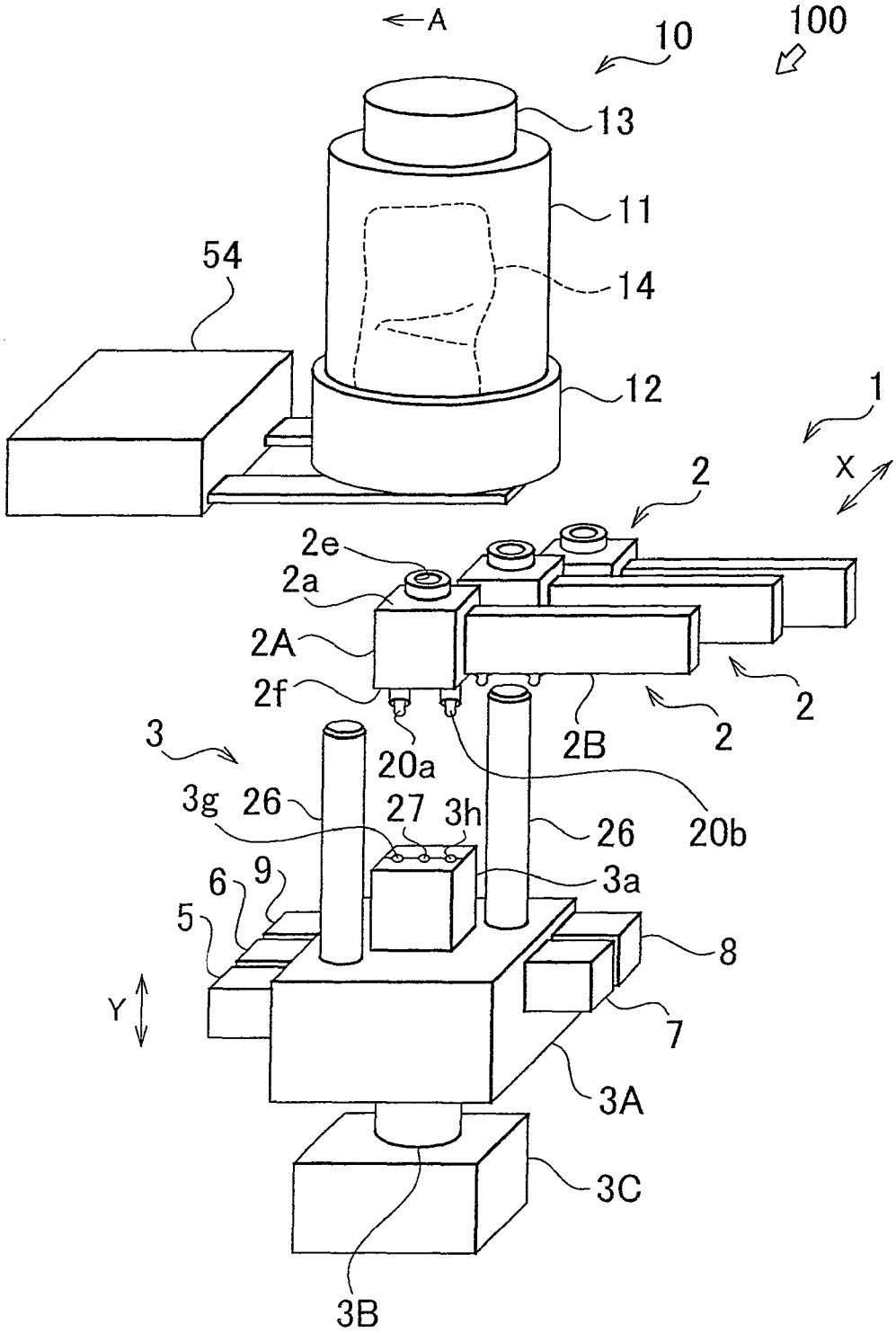
FIG. 1 is a perspective view showing an overall construction of a paint filling apparatus in accordance with an embodiment of the invention.

[GENERAL CONSTRUCTION OF PAINT FILLING APPARATUS 1] Firstly, a general construction of a paint filling apparatus 1 in accordance with an embodiment of the invention will be described with reference to FIG. 1. Incidentally, for the sake of convenience in the following description, the up-down or vertical directions in FIG. 1 are defined as up-down or vertical directions regarding the paint filling apparatus 1, and the direction of an arrow A in FIG. 1 is defined as a forward direction.

The paint filling apparatus 1 is constructed to be attachable to and detachable from a paint cartridge 10, and to fill an inside of the paint cartridge 1 with a paint of a color paint that is arbitrarily selected from a plurality of paints of different colors. The paint filling apparatus 1 is constructed mainly of a plurality of header portions 2 and one common manifold portion 3. Each header portion 2 and the common manifold portion 3 are attached to and detachable from each other. The header portions 2 and the common manifold portion 3 are disposed below the paint cartridge 10. The header portions 2 are disposed above the common manifold portion 3. The paint cartridge 10 is disposed above the header portions 2 and vertically over the common manifold portion 3.

Firstly, a general construction of the header portions 2 will be described. Each header portion 2 is constructed of a body portion 2A whose upper surface is provided with a paint port 2*e*, an extension portion 2B that extends rearward from a side surface of the body portion 2A, etc.

As described in detail later, an inside of the body portion 2A is provided with a first cleaning liquid channel 2*c* and a first waste liquid channel 2*d* (see FIG. 2). The two channels 2*c* and 2*d* communicate with a first stop valve 20*a* and a second stop valve 20*b*, respectively, that are provided in a lower surface of the body portion 2A. Besides, a paint channel 2*b* is formed within the extension portion 2B (see FIG. 2). The paint channel 2*b* communicates with a paint valve 4 (see FIG. 2) that is provided on an extension end of the extension portion 2B.

The header portions 2 constructed as described above are provided separately for each of colors of paints. Above the common manifold portion 3, the head portions 2 are disposed side by side in a left-right horizontal direction (i.e., a direction orthogonal to the direction of extension of the extension portion 2B and to the vertical movement direction of the common manifold portion 3).

A conveyor device 51 (see FIG. 2) is provided near the header portions 2. The header portions 2 can be moved in the left and right horizontal directions (the directions of the arrow X shown in FIG. 1) by the conveyor device 51. There is provided a construction in which one of the header portions that corresponds to a selected color paint is conveyed to a position that is vertically over the common manifold portion 3.

Next, a general construction of the common manifold portion 3 will be described. The common manifold portion 3 in this embodiment has functions of supplying a cleaning liquid to and therefore performing the cleaning of a channel that is provided for supplying paint from the selected header portion 2 to the paint cartridge, and of discharging the waste cleaning liquid from the channel, and also has a function of supplying compressed air for more certainly discharging the waste liquid to the outside of the paint filling apparatus 1, and a function of supplying an extrusion liquid that is needed in conjunction with an internal construction of the paint cartridge 10, etc.

The common manifold portion 3 is constructed of a body portion 3A, an actuator 3B, a base portion 3C, etc. A substantially central portion of an upper surface of the body portion 3A that is central in a plan view is provided with a connector portion 3*a*. Two extrusion liquid pipings 26 extend upward at sides of the connector portion 3*a* on the upper surface of the body portion 3A. Besides, the actuator 3B is constructed of a hydraulic cylinder and the like, and is disposed on a lower surface of the body portion 3A, and is capable of moving the body portion 3A in the up-down directions. Furthermore, the base portion 3C is provided as a base of the common manifold portion 3 as a whole, and is disposed on a lower surface of the actuator 3B. Incidentally, the actuator 3B is not limited to the construction described in conjunction with this embodiment, but may also be, for example, an electromagnetic type actuator, such as an electric type actuator.

In the common manifold portion 3, side surfaces of the body portion 3A are provided with a plurality of electromagnetic valves (a cleaning liquid valve 5, an air valve 6, a waste liquid valve 7, an extrusion liquid supply valve, an extrusion liquid discharge valve 9, etc.). As described in detail later, an inside of the body portion 3A is provided with a plurality of channels (a second cleaning liquid channel 3*b*, an air channel 3*c*, a second waste liquid channel 3*d*, a second extrusion liquid supply channel 3*e*, a second extrusion liquid discharge channel 3*f*, etc., as shown in FIG. 2). These channels 3*b*, 3*c*, . . . , 3*f* are linked in communication with the foregoing electromagnetic valves 5, 6, . . . , 9.

The number of the common manifold portion 3 provided in the paint filling apparatus 1 is one. Equipped with the base portion 3C as a base, the body portion 3A is capable of being moved up and down in the vertical directions (the directions of the arrow Y in FIG. 1) by the actuator 3B.

[CHANNEL CONSTRUCTION OF PAINT FILLING SYSTEM 100] Next, a channel construction of a paint filling system 100 equipped with the paint filling apparatus in accordance with an embodiment of the invention will be described with reference to FIG. 2. Incidentally, for the sake of convenience in description, the up-down direction in FIG. 2 are assumed to be the up-down directions regarding the paint filling system 100.

Figure 2:
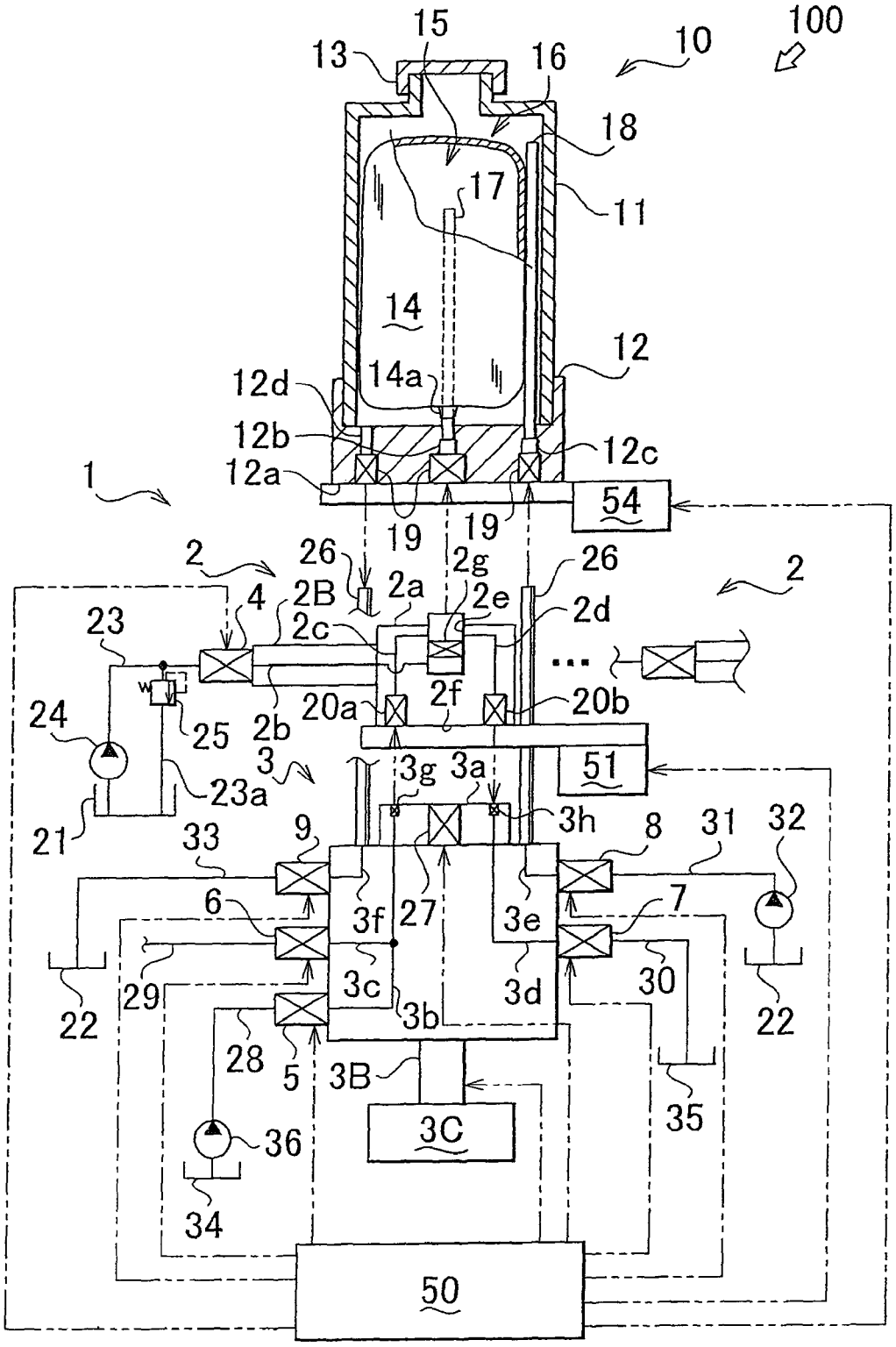
FIG. 2 is a block diagram showing an overall construction of a paint filling system that is equipped with a paint filling apparatus in accordance with an embodiment of the invention.

The paint filling system 100 is constructed mainly of the paint cartridge 10, which is presently empty, the paint filling apparatus 1, a plurality of paint tanks 21 provided separately for each of colors of paints (only one tank 21 is shown in FIG. 2), an extrusion liquid tank 22, a cleaning liquid tank 34, a waste liquid tank 35, etc. The paint filling system 100 is controlled by a control device 50 described below.

Firstly, an example of the paint cartridge 10 in the embodiment will be described. The paint cartridge 10 is constructed to be attachable to and detachable from an electrostatic painting machine (not shown) and the paint filling apparatus 1. The paint cartridge 10, when attached to the electrostatic painting machine, supplies the paint stored therein to the electrostatic painting machine. Then, when the paint cartridge 10 is empty, the paint cartridge 10 is attached to the paint filling apparatus 1, so that the empty interior of the paint cartridge 10 is filled with the paint again. The paint cartridge 10 is constructed mainly of a body portion 11, a base portion 12, a paint bag 14, etc.

The body portion 11 is made up of a member that is made of an anti-solvent resin, and is formed so as to have a generally cylindrical shape. Besides, an upper end portion of the body portion 11 has, in its central portion in a plan view, an opening portion that is protruded upward (i.e., in the direction of extension of the body portion 11). The opening portion is closed with a lid portion 13.

The base portion 12 of the paint cartridge 10 is attached to a lower end portion of the body portion 11 so as to close an opening of the body portion 11. Besides, a lower surface of the base portion 12 is provided with a attachment-detachment surface 12*a* that is attachable and detachable with respect to a paint cartridge attachment portion of an electrostatic painting machine (not shown) and to a support end surface 2*a* of each header portion 2 described below.

An inside of the base portion 12 is provided with a paint channel 12*b*, a first extrusion liquid supply channel 12*c* and a first extrusion liquid discharge channel 12*d*. These channels 12*b*, 12*c* and 12*d* provide communication between the inside of the body portion 11 of the paint cartridge 10 and the outside of the paint cartridge 10.

These channels 12*b*, 12*c* and 12*d* communicate with stop valves 19, respectively, that are provided facing the attachment-detachment surface 12*a*. Via the stop valves 19, the open-closed state of the channels 12*b*, 12*c* and 12*d* is controlled.

These stop valves 19 usually maintain their "closed" state, and enter the "open" state when the paint port 2*e* of a header portion 2 and the extrusion liquid pipings 26 and 26 of the common manifold portion 3 are linked in communicate with the channels 12*b*, 12*c* and 12*d*, respectively.

The paint bag 14 is made of a flexible resin-made member, and has a bag shape. A lower end portion of the paint bag 14 is provided with an opening portion 14*a* that provides communication between the inside and the outside of the paint bag 14.

The inside of the body portion 11 of the paint cartridge 10 is provided with a paint move pipe 17 that protrudes vertical upward (in the direction of extension of the body portion 11). A lower end portion of the paint move pipe 17 is fitted to the paint channel 12*b* that is formed in the base portion 12. That is, the paint move pipe 17 is linked in communication with a corresponding one of the stop valves 19 through the paint channel 12*b*.

Inside the body portion 11 of the paint cartridge 10, the paint bag 14 is disposed with its opening portion 14*a* facing downward. Through the opening portion 14*a*, an upper portion of the paint move pipe 17 is inserted into the paint bag 14. That is, the inside of the paint bag 14 is linked in communication with the outside of the cartridge 10 through the paint move pipe 17 and the paint channel 12*b*.

On the other hand, inside the body portion 11 of the paint cartridge 10, an extrusion liquid move pipe 18 extends vertically upward (in the direction of extension of the body portion 11) outside the paint bag 14. A lower end portion of the extrusion liquid move pipe 18 is fitted to the first extrusion liquid supply channel 12*c* that is formed in the base portion 12. That is, the extrusion liquid move pipe 18 is linked in communication with a corresponding one of the stop valves 19 through the first extrusion liquid supply channel 12*c*.

Thus, the outside of the paint bag 14 is linked in communication with the outside of the paint cartridge 10 through the extrusion liquid move pipe 18 and the first extrusion liquid supply channel 12*c*. Incidentally, the first extrusion liquid discharge channel 12*d* also provides communication between the outside of the paint bag 14 within the paint cartridge 10 and the outside of the paint cartridge 10.

By supplying a paint into the paint cartridge 10 through the paint move pipe 17, the paint is filled into only the inside of the paint bag 14. Therefore, by supplying the extrusion liquid into the paint cartridge 10 through the extrusion liquid move pipe 18, the extrusion liquid is filled into only a space outside the paint bag 14 which is inside the body portion 11.

Thus, the region in the paint cartridge 10 is divided by the paint bag 14 into a paint chamber 15 into which paint is filled and an extrusion liquid chamber 16 into which the extrusion liquid for extruding the paint from the paint chamber 15 is filled, so that the paint and the extrusion liquid are prevented from mixing with each other.

The paint bag 14 deforms and shrinks when the extrusion liquid is filled into the extrusion liquid chamber 16, so that paint within the paint bag 14 is extruded out to the outside of the paint cartridge 10. On the other hand, the paint bag 14, when paint is filled thereinto, deforms and expands, so that the extrusion liquid remaining in the extrusion liquid chamber 16 is extruded out to the outside of the paint cartridge 10.

A conveyor device 54 as a movement device is disposed near the paint cartridge 10 that is constructed as described above. The conveyor device 54 moves the paint cartridge 10 whose interior is empty to a position above the paint filling apparatus 1.

Incidentally, the construction of the paint cartridge 10 is not limited by the foregoing embodiment, but may be any construction as long as the construction includes a cartridge type container that has a space into which to fill a paint and that is attachable and detachable with respect to an electrostatic painting machine (not shown) and the paint filling apparatus 1.

Next, the paint filling apparatus 1 will be described. The paint filling apparatus 1 is constructed of a plurality of header portions 2 and one common manifold portion 3 as described above.

Firstly, the header portions 2 will be described. The header portions 2 are provided separately for each of colors of paints. An upper surface of each header portion 2 is provided with the support end surface 2*a* that is attachable to and detachable from the attachment-detachment surface 12*a* of the paint cartridge 10, which is a lower surface thereof. When the paint cartridge 10 is to be attached to the paint filling apparatus 1, the paint cartridge 10 is firmly held on the upper surface of a selected one of the header portions 2 via the support end surface 2*a* of the header portion 2. On the other hand, a lower surface of each header portion 2 is provided with an attachment-detachment surface 2*f* that is attachable to and detachable from an upper surface of the connector portion 3*a* of the common manifold portion 3 described below. Thus, each header portion 2 is provided so that one side thereof is attachable to and detachable from the paint cartridge 10, and so that another side thereof is attachable to and detachable from the common manifold portion 3.

A paint channel 2*b*, a first cleaning liquid channel 2*c* and a first waste liquid channel 2*d* are formed in each header portion 2. These channels 2*b*, 2*c* and 2*d* are linked with each other via one paint port 2*e*.

The paint port 2*e* of each header portion 2 is provided on a support end surface 2*a* that is formed in an upper surface of the header portion 2. When the paint cartridge 10 is firmly held on the support end surface 2*a* of a header portion 2, the paint port 2*e* of the header portion 2 is linked in communication with the paint channel 12*b* of the paint cartridge 10 (more specifically, with a corresponding one of the stop valves 19 linked in communication with the paint channel 12*b*).

The paint channel 2*b* of each header portion 2 is a channel for filling paint into the paint cartridge 10. An end portion of the paint channel 2*b* is linked in communication with the paint port 2*e*. In other words, an end portion of the paint channel 2*b* is detachably linked in communication with the inside of the paint cartridge 10 via the paint port 2*e*. On the other hand, another end portion of the paint channel 2*b* is linked in communicate with the electromagnetic paint valve 4 that controls the open-closed state of the paint channel 2*b*.

Beside, a piping member 23 is linked in communication with the paint valve 4. A terminal end portion of the piping member 23 (an opposite end portion thereof to an end portion thereof that is linked in communication with the paint valve 4) is inserted into the inside of the paint tank 21 that is a paint supply source. That is, the paint channel 2*b* is linked in communication with the paint tank 21 via the paint valve 4 and the piping member 23, and is also linked in communication with the paint channel 12*b* of the paint cartridge 10 via the paint port 2*e*. In other words, the piping member 23 and the paint channel 2*b* constitute a paint supply channel that supplies the paint in the paint tank 21 into the paint channel 12*b* of the paint cartridge 10, and the paint valve 4 is disposed in air intermediate portion of the paint supply channel, that is, between the piping member 23 and the paint channel 2*b*.

The paint in the paint tank 21 is sent to the paint valve 4 through the piping member 23, and the paint sent to the paint valve 4 is sent to the paint port 2*e* of the header portion 2 through the paint channel 2*b*. The paint sent into the paint port 2*e* then flows into the paint channel 12*b* via the corresponding stop valve 19 of the paint cartridge 10, which is connected to the header portion 2. Then, through the paint channel 12*b*, the paint is sent into the paint move pipe 17. The paint sent into the paint move pipe 17 finally flows into and fills the paint bag 14 within the paint cartridge 10.

Incidentally, an intermediate portion of the piping member 23 is provided with a paint pump 24 that pumps the paint stored in the paint tank 21 to the paint valve 4.

A branch channel 23*a* is provided on the piping member 23 at a downstream side of the paint pump 24. A terminal end portion of the branch channel 23*a* (i.e., an end portion thereof opposite an end portion that is linked in communication with an intermediate portion of the piping member 23) is inserted into the paint tank 21. An intermediate portion of the branch channel 23*a* is provided with a relief valve 25. If the pressure of the paint that flows within the piping member 23 exceeds a set value of the relief valve 25, the relief valve 25 causes the paint to return to the paint tank 21 through the branch channel 23*a*.

Incidentally, a plurality of paint tanks 21 that are paint supply sources as described above are provided separately for each of colors of paints. These paint tanks 21 are linked in communication with the header portions 2 via the paint valves 4, respectively.

The first cleaning liquid channel 2*c* of each header portion 2 is a channel for supplying a cleaning liquid for clearing a site of attachment and detachment between the header portion 2 and the paint cartridge 10, that is, a site of linkage in communication between the paint port 2*e* and the corresponding one of the stop valves 19. An end portion of the first cleaning liquid channel 2*c* is linked in communication with the paint port 2*e*, and another end portion of the first cleaning liquid channel 2*c* is linked in communication with the first stop valve 20*a* that is provided facing the attachment-detachment surface 2*f*. The first stop valve 20*a* controls the open-closed state of the first cleaning liquid channel 2*c*.

Incidentally, the first stop valve 20*a* usually maintains the "closed" state, and enters the "open" state when a cleaning liquid port 3*g* of the common manifold portion 3 (which is described below) is linked in communication with the first cleaning liquid channel 2*c*.

The first waste liquid channel 2*d* is a channel for discharging the post-clearing waste liquid from the site of linkage in communication between the paint port 2*e* of the header portion 2 and the corresponding one of the stop valves 19 of the paint cartridge 10 to the outside of the paint filling apparatus 1. The first waste liquid channel 2*d* is provided at an opposite side of the paint port 2*e* to the first cleaning liquid channel 2*c*.

That is, an end portion of the first waste liquid channel 2*d* is linked in communication with the paint port 2*e*, and another end portion thereof is linked in communication with the second stop valve 20*b* that faces the attachment-detachment surface 2*f* and is provided side by side with the first stop valve 20*a*. The second stop valve 20*b* controls the open-closed state of the first waste liquid channel 2*d*.

Incidentally, the second stop valve 20*b* usually maintains the "closed" state, and enters the "open" state when a waste liquid port 3*h* of the common manifold portion 3 (which will be described below) is linked in communication with the first waste liquid channel 2*d*.

Thus, inside the header portion 2, a branch channel made up of the first cleaning liquid channel 2*c* and the first waste liquid channel 2*d* is formed near the site of linkage in communication between the paint channel 2*b* and the paint cartridge 10, that is, near the paint port 2*e*.

An open-close valve 2*g* is housed in the paint port 2*e*. The open-close valve 2*g* is provided slidably in the paint port 2*e*. According to its sliding movement, the open-close valve 2*g* controls the state of linkage in communication among the paint channel 2*b*, the first cleaning liquid channel 2*c* and the first waste liquid channel 2*d* at the paint port 2*e*.

That is, the open-close valve 2*g* is constructed so that as the valve 2*g* slides in the paint port 2*e*, the open-close valve 2*g* switches between a state in which the first cleaning liquid channel 2*c* and the first waste liquid channel 2*d* are in communication with the paint port 2*e* and the communication between the paint channel 2*b* and the paint port 2*e* is shut off, and a state in which the paint channel 2*b* is in communication with the paint port 2*e* and the communication of the first cleaning liquid channel 2*c* and the first waste liquid channel 2*d* with the paint port 2*e* is shut off.

In other words, the open-close valve 2*g* has a function of controlling the open-closed state of the paint channel 2*b*, that is, the state of communication and the state of discontinuation of the communication between the paint channel 2*b* and the inside of the paint cartridge 10 via the paint port 2*e*. That is, in the upstream side of the paint channel 2*b*, the open-closed state of the paint channel 2*b* is controlled by the paint valve 4, whereas in the downstream side thereof, the open-closed state of the paint channel 2*b* is controlled by the open-close valve 2*g*.

Incidentally, the sliding movement of the open-close valve 2*g* is actuated by a trigger valve 27 of the common manifold portion 3 (which will be described below).

As described above, a plurality of header portions 2 are provided separately for each of colors of paints, for the paint cartridge 10 into which a selected one of the color paints is filled. Each header portion 2 has the paint channel 2*b* therein, and is linked in communication with a corresponding one of the paint tanks 21 that are provided separately for each of colors of paints. That is, the header portions 2 function as a paint supply portion that fills a selected one of paints into the paint cartridge 10.

The conveyor device 51 as a movement device is disposed near the header portions 2. By the conveyor device 51, the header portion 2 that corresponds to the paint of the selected color is moved to a position that is under the paint cartridge 10 and over the common manifold portion 3.

Next, the common manifold portion 3 will be described. The common manifold portion 3 is provided as a mediating channel that is used when the extrusion liquid is filled into the paint cartridge 10 so as to compress the paint bag 14 and therefore extrude paint from the paint bag 14 to the outside of the paint cartridge 10, and when the cleaning liquid is sent to the attachment-detachment site between the paint cartridge 10 and a selected one of the header portions 2, and when the post-clearing waste liquid is discharged to the outside of the paint filling apparatus 1, etc.

The upper surface of the common manifold portion 3 is provided with the rectangular connector portion 3*a* that is protruded upward. An upper surface of the connector portion 3*a* is provided with the trigger valve 27, the cleaning liquid port 3*g* and the waste liquid port 3*h*.

When the common manifold portion 3 is disposed so as to be attachable to and detachable from, via the connector portion 3*a*, the attachment-detachment surface 2*f* provided in the lower surface of a selected one of the header portions 2, and the header portion 2 is attached (linked) to the common manifold portion 3, the cleaning liquid port 3*g* and the first stop valve 20*a* of the header portion 2 come to communicate with each other, and the waste liquid port 3*h* and the second stop valve 20*b* of the header portion 2 come to communicate with each other.

Incidentally, the trigger valve 27 is equipped with a push rod (not shown). When a selected one of the header portions 2 is attached to the common manifold portion 3, the push rod becomes engaged with the open-close valve 2*g* that is housed within the paint port 2*e* of the header portion 2, so that the actions of the trigger valve 27 are coordinated with those of the open-close valve 2*g* via the push rod. That is, the open-close valve 2*g*, in coordination with the actions of the trigger valve 27, slides within the paint port 2*e* to control the open-closed state of the paint channel 2*b*.

Besides, on the upper surface of the common manifold portion 3, two extrusion liquid pipings 26 extend upward (in the direction from the upper surface of the common manifold portion 3 toward the lower surface of the paint cartridge 10) around the connector portion 3*a*.

When the upper surface of the connector portion 3*a* of the common manifold portion 3 is attached to the attachment-detachment surface 2*f* provided in the lower surface of a selected one of the header portions 2 in order to fill the paint into the paint cartridge 10, upper end portions of the two extrusion liquid pipings 26 are linked in communication with the first extrusion liquid supply channel 12*c* and the first extrusion liquid discharge channel 12*d*, respectively, of the paint cartridge 10.

Inside the common manifold portion 3, there are formed a second cleaning liquid channel 3*b*, an air channel 3*c*, a second waste liquid channel 3*d*, a second extrusion liquid supply channel 3*e* and a second extrusion liquid discharge channel 3*f*. These channels 3*b*, 3*c*, . . . , 3*f* are linked in communication with the connector portion 3*a* or either one of the extrusion liquid pipings 26 on the upper surface of the common manifold portion 3.

The second cleaning liquid channel 3*b* is a channel for supplying the cleaning liquid to the first cleaning liquid channel 2*c* of each header portion 2. An end portion of the second cleaning liquid channel 3*b* is linked in communication with the cleaning liquid port 3*g* that is provided in the upper surface of the connector portion 3*a*. In other words, the end portion of the second cleaning liquid channel 3*b* is detachably linked in communication with the first cleaning liquid channel 2*c* in the selected header portion 2, via the cleaning liquid port 3*g*. On the other hand, another end portion of the second cleaning liquid channel 3*b* is linked in communication with the electromagnetic type cleaning liquid valve 5 that controls the open-closed state of the second cleaning liquid channel 3*b*.

Besides, a piping member 28 is linked in communication with the cleaning liquid valve 5. A terminal end portion of the piping member 28 (an opposite end portion thereof to an end portion that is linked in communication with the cleaning liquid valve 5) is inserted into the cleaning liquid tank 34, which is a cleaning liquid supply source. That is, the second cleaning liquid channel 3*b* is linked in communication with the cleaning liquid tank 34 via the cleaning liquid valve 5 and the piping member 28, and is also linked in communication with the first cleaning liquid channel 2*c* of a selected one of the header portions 2 via the cleaning liquid port 3*g*. In other words, the piping member 28 and the second cleaning liquid channel 3*b* constitute a cleaning liquid supply channel that supplies the cleaning liquid from the cleaning liquid tank 34 to the first cleaning liquid channel 2*c* of a selected one of the header portions 2. An intermediate portion of the cleaning liquid supply channel, that is, a portion thereof between the piping member 28 and the second cleaning liquid channel 3*b*, is provided with the cleaning liquid valve 5.

The cleaning liquid in the cleaning liquid tank is then sent into the common manifold portion 3 through the piping member 28. After being sent into the common manifold portion 3, the cleaning liquid is sent into the second cleaning liquid channel 3*b* via the cleaning liquid valve 5. After being sent into the second cleaning liquid channel 3*b*, the cleaning liquid is sent into the header portion 2 via the cleaning liquid port 3*g*. From the header portion 2, the cleaning liquid is sent into the first cleaning liquid channel 2*c* via the first stop valve 20*a*. Then, the cleaning liquid sent into the first cleaning liquid channel 2*c* is finally supplied into the paint port 2*e*.

Incidentally, a cleaning liquid pump 36 is disposed near a terminal end portion of the piping member 28. The cleaning liquid pump 36 pumps the cleaning liquid from the cleaning liquid tank 34 to the cleaning liquid valve 5.

The air channel 3*c* is a channel for supplying compressed air in order to discharge the post-cleaning waste liquid from a site of linkage in communication between the stop valve 19 of the paint cartridge 10 and the paint port 2*e* of the header portion 2 to the outside of the paint filling apparatus 1. An end portion of the air channel 3*c* is linked in communication with an intermediate portion of the second cleaning liquid channel 3*b*, and another end portion of the air channel 3*c* is linked in communication with the electromagnetic type air valve 6.

Besides, a piping member 29 is linked in communication with the air valve 6. A terminal end portion of the piping member 29 (an opposite end portion thereof to an end portion thereof that is linked in communication with the intermediate portion of the second cleaning liquid channel 3*b*) is linked in communication with an air source that is not shown in the drawings (i.e., a compressed air supply source made up of a compressor or the like). That is, the air channel 3*c*, which is linked in communication with the air source via the air valve 6 and the piping member 29, is also linked in communication with the second cleaning liquid channel 3*b*, so that the air channel 3*c* is linked in communication with the first cleaning liquid channel 2*c* of a selected one of the header portions 2 via the cleaning liquid port 3*g*.

The compressed air discharged from the air source is sent to the air valve 6 through the piping member 29. After being sent to the air valve 6, the compressed air is sent into the air channel 3*c* of the common manifold portion 3. From the air channel 3*c*, the compressed air is sent into the selected 2 through the second cleaning liquid channel 3*b* and through the cleaning liquid port 3*g*. The compressed air sent into the header portion 2 is then sent into the first cleaning liquid channel 2*c* via the first stop valve 20*a*. Then, the compressed air sent into the first cleaning liquid channel 2*c* is finally supplied into the paint port 2*e*.

The second waste liquid channel 3*d* is a channel for discharging to the outside of the paint filling apparatus 1 the waste liquid that is discharged through the first waste liquid channel 2*d* of the header portion 2. An end portion of the second waste liquid channel 3*d* is linked in communication with the waste liquid port 3*h* that is provided in the upper surface of the connector portion 3*a*. In other words, an end portion of the second waste liquid channel 3*d* is detachably linked in communication with the first waste liquid channel 2*d* provided within a selected one of the header portions 2, via the waste liquid port 3*h*. On the other hand, another end portion of the second waste liquid channel 3*d* is linked in communication with an electromagnetic type waste liquid valve 7 that controls the open-closed state of the second waste liquid channel 3*d*.

Besides, a piping member 30 is linked in communication with the waste liquid valve 7. A terminal end portion of the piping member 30 (an opposite end portion thereof to an end portion thereof that is linked in communication with the waste liquid valve 7) is inserted into a waste liquid tank 35.

That is, the second waste liquid channel 3*d* is linked in communication with the waste liquid tank 35 via the waste liquid valve 7 and the piping member 30, and is also linked in communication with the first waste liquid channel 2*d* of a selected one of the header portions 2 via the waste liquid port 3*h*. In other words, the piping member 30 and the second waste liquid channel 3*d* constitute a waste liquid discharge channel that discharges waste liquid from the first waste liquid channel 2*d* of a selected one of the header portions 2 into the waste liquid tank 35. An intermediate portion of the waste liquid discharge channel, that is, a portion between the piping member 30 and the second waste liquid channel 3*d*, is provided with the waste liquid valve 7.

The post-cleaning waste liquid at a site of linkage in communication between the stop valve 19 of the paint cartridge 10 and the paint port 2*e* of the header portion 2 flows through the first waste liquid channel 2*d* of the header portion 2, and reaches the second stop valve 20*b*. After that, the waste liquid is sent into the common manifold portion 3, and then is sent into the second waste liquid channel 3*d* via the waste liquid port 3*h*. After being sent into the second waste liquid channel 3*d*, the waste liquid is sent into the piping member 30 via the waste liquid valve 7. Then, the waste liquid sent into the piping member 30 is finally sent into the waste liquid tank 35.

The second extrusion liquid supply channel 3*e* is a channel for filling the extrusion liquid into the paint cartridge 10. An end portion of the second extrusion liquid supply channel 3*e* is linked in communication with the extrusion liquid piping 26 that extends upward from the upper surface of the common manifold portion 3. In other words; the foregoing end portion of the second extrusion liquid supply channel 3*e* is detachably linked in communication with the inside of the paint cartridge 10 via the extrusion liquid piping 26. On the other hand, another end portion of the second extrusion liquid supply channel 3*e* is linked in communication with the electromagnetic type extrusion liquid supply valve 8 that controls the open-closed state of the second extrusion liquid supply channel 3*e*.

Besides, a piping member 31 is linked in communication with the extrusion liquid supply valve 8. A terminal end portion of the piping member 31 (an opposite end portion thereof to an end portion thereof that is linked in communication with the extrusion liquid supply valve 8) is inserted into the extrusion liquid tank 22, which is an extrusion liquid supply source. That is, the second extrusion liquid supply channel 3*e* is linked in communication with the extrusion liquid tank 22 via the extrusion liquid supply valve 8 and the piping member 31, and is also linked in communication with the first extrusion liquid supply channel 12*c* of the paint cartridge 10 via the extrusion liquid piping 26.

The extrusion liquid in the extrusion liquid tank 22 is sent to the common manifold portion 3 through the piping member 31. After being sent into the common manifold portion 3, the extrusion liquid is sent into the extrusion liquid piping 26 via the extrusion liquid supply valve 8 and through the second extrusion liquid supply channel 3*e*. The extrusion liquid sent into the extrusion liquid piping 26 is then sent into the extrusion liquid move pipe 18 via the stop valve 19 and through the first extrusion liquid supply channel 12*c*. The extrusion liquid sent into the extrusion liquid move pipe 18 is finally filled into the paint cartridge 10.

Incidentally, an extrusion liquid pump 32 is disposed near the terminal end portion of the piping member 31. The extrusion liquid pump 32 pumps the extrusion liquid residing inside the extrusion liquid tank 22 to the extrusion liquid supply valve 8.

The second extrusion liquid discharge channel 3*f* is a channel for discharging the extrusion liquid residing inside the paint cartridge 10 to the outside of the paint filling apparatus 1 when paint is filled into the paint cartridge 10. An end portion of the second extrusion liquid discharge channel 3*f* is linked in communication with the extrusion liquid piping 26 that extends upward from the upper surface of the common manifold portion 3. In other words, the foregoing end portion of the second extrusion liquid discharge channel 3*f* is detachably linked in communication with the inside of the paint cartridge 10 via the extrusion liquid piping 26. Another end portion of the second extrusion liquid discharge channel 3*f* is linked in communication with the electromagnetic type extrusion liquid discharge valve 9 that controls the open-closed state of the second extrusion liquid discharge channel 3*f*.

Besides, a piping member 33 is linked in communication with the extrusion liquid discharge valve 9. A terminal end portion of the piping member 33 (an opposite end portion thereof to an end portion thereof that is linked in communication with the extrusion liquid discharge valve 9) is inserted into the foregoing extrusion liquid tank 22, which is an extrusion liquid supply source.

That is, the second extrusion liquid discharge channel 3*f* is linked in communication with the extrusion liquid tank 22 via the extrusion liquid discharge valve 9 and the piping member 33, and is also linked in communication with the first extrusion liquid discharge channel 12*d* of the paint cartridge 10 via the extrusion liquid piping 26.

The extrusion liquid in the paint cartridge 10 flows through the first extrusion liquid discharge channel 12*d*, and reaches the stop valve 19. After that, the extrusion liquid is sent to the extrusion liquid piping 26, and is sent from the extrusion liquid piping 26 into the second extrusion liquid discharge channel 3*f*. The extrusion liquid sent into the second extrusion liquid discharge channel 3*f* is then sent into the piping member 33 via the extrusion liquid discharge valve 9. The extrusion liquid sent into the piping member 33 is finally sent into the extrusion liquid tank 22.

As described above, the common manifold portion 3 has the channels 3*b*, 3*c*, . . . , 3*f* that are related to the cleaning liquid, the waste liquid, the extrusion liquid, etc., which are needed for all the paint cartridges 10 that are filled with paints.

Incidentally, in the paint filling apparatus 1 of the embodiment, the paint channel 2*b* is formed in each of a plurality of header portions 2, and the foregoing channels 3*b*, 3*c*, . . . , 3*f* related to the cleaning liquid, the waste liquid, the extrusion liquid, etc. are formed within the common manifold portion 3. However, the invention is not limited to this construction. That is, for a reason in terms of layout of the entire facility, or the like, one or more of the channels 3*b*, 3*c*, . . . , 3*f* related to the cleaning liquid, the waste liquid and the extrusion liquid are provided within the header portions 2, so that each header portion 2 is provided with not only the function of supplying paint but also the function of supplying the cleaning liquid and the extrusion liquid, and the like.

A lower portion of the common manifold portion 3 is provided with an actuator 3B as an elongation device that elongates the common manifold portion 3 as a whole in the vertical direction. As the actuator 3B raises the body portion 3A (see FIG. 1), the common manifold portion 3 as a whole elongates upward, so that the body portion 3A of the common manifold portion 3 can be detachably attached to a selected one of the header portions 2 that is positioned over the body portion 3A.

[CONTROL DEVICE 50] Next, the control device 50 will be described with reference to FIG. 2. The control device 50 is provided for controlling various actions that are performed by the paint filling apparatus 1 so as to fill the paint cartridge 10 with a paint.

The control device 50 is connected with a keyboard, a barcode reader or the like (not shown) as an input device, and is connected to various output devices, including the conveyor device 51 disposed near the header portions 2, the actuator 3B of the common manifold portion 3, the conveyor device 54 disposed near the paint cartridge 10, the electromagnetic type valves (such as the paint valve 4, the cleaning liquid valve 5, the air valve 6, the waste liquid valve 7, the extrusion liquid supply valve 8 and the extrusion liquid discharge valve 9), the trigger valve 27, etc.

The control device 50 is constructed mainly of a storage portion made up of a RAM, a ROM, etc., a computation process portion made up of a CPU, etc. Execution programs regarding actions of the paint filling apparatus 1 that are performed to fill a paint into the paint cartridge 10 are prestored in the storage portion. Besides, information input from the input device according to a command from the computation process portion.

The information input via the input device, programs regarding the operation of the apparatus (e.g., the opening and closing actions regarding the valves 4, 5, . . . , 9, the ascending and descending actions regarding the actuator 3B, etc.), etc., are read from the storage portion, and computation processes are accordingly executed by the computation process portion. After that, on the basis of results of computations, the control device 50 gives commands regarding the operation to the output devices.

Figure 3:
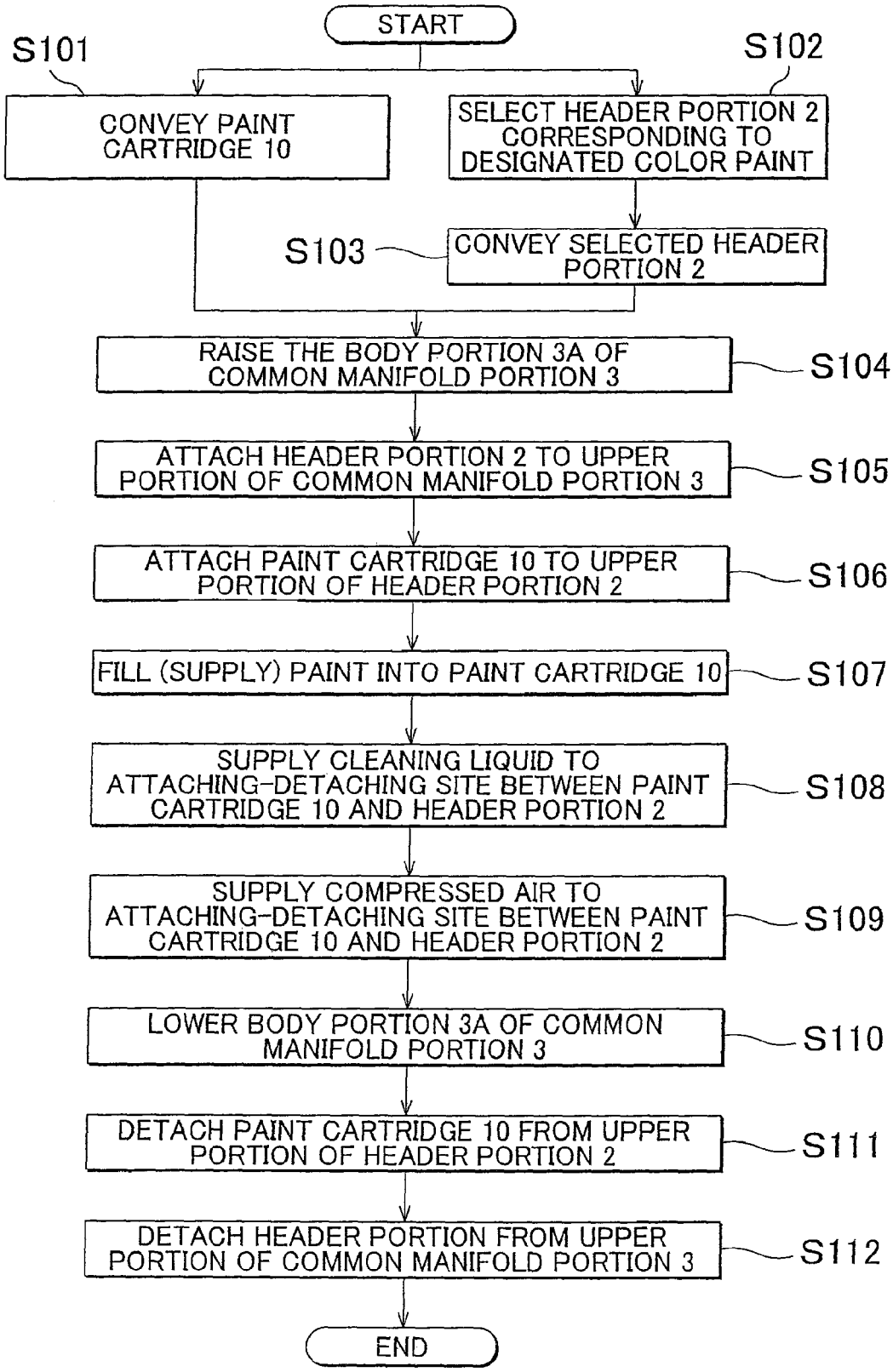
FIG. 3 is a flowchart showing actions that the paint filling apparatus performs when filling a paint into a paint cartridge.

[ACTIONS OF PAINT FILLING APPARATUS 1] Next, actions of the paint filling apparatus 1 will be described with reference to FIG. 3 and FIGS. 4A and 4B. Incidentally, for the sake of convenience, the up-down direction in FIGS. 4A and 4B is defined as the up-down direction of the paint filling apparatus 1, and the direction of an arrow A in FIGS. 4A and 4B is defined as a forward direction of the paint filling apparatus 1.

Firstly, the information regarding a paint to be filled into the paint cartridge 10 is input to the control device 50 via the input device. In the control device 50, a computation process is performed by the computation process portion on the basis of the input information, and a command signal regarding the operation of the conveyor device 54 is sent out. Receiving the command signal, the conveyor device 54 takes thereon the paint cartridge 10 that is empty, and conveys the paint cartridge 10 to a predetermined position that is located vertically over the common manifold portion 3 (step S101).

On the other hand, in the control device 50, a header portion 2 corresponding to the paint of the designated color is selected from the plurality of header portions 2 by a computation process of the computation process portion (step S102), and a command signal regarding the operation of the conveyor device 51 (see FIG. 2) is sent out.

Figure 4A:
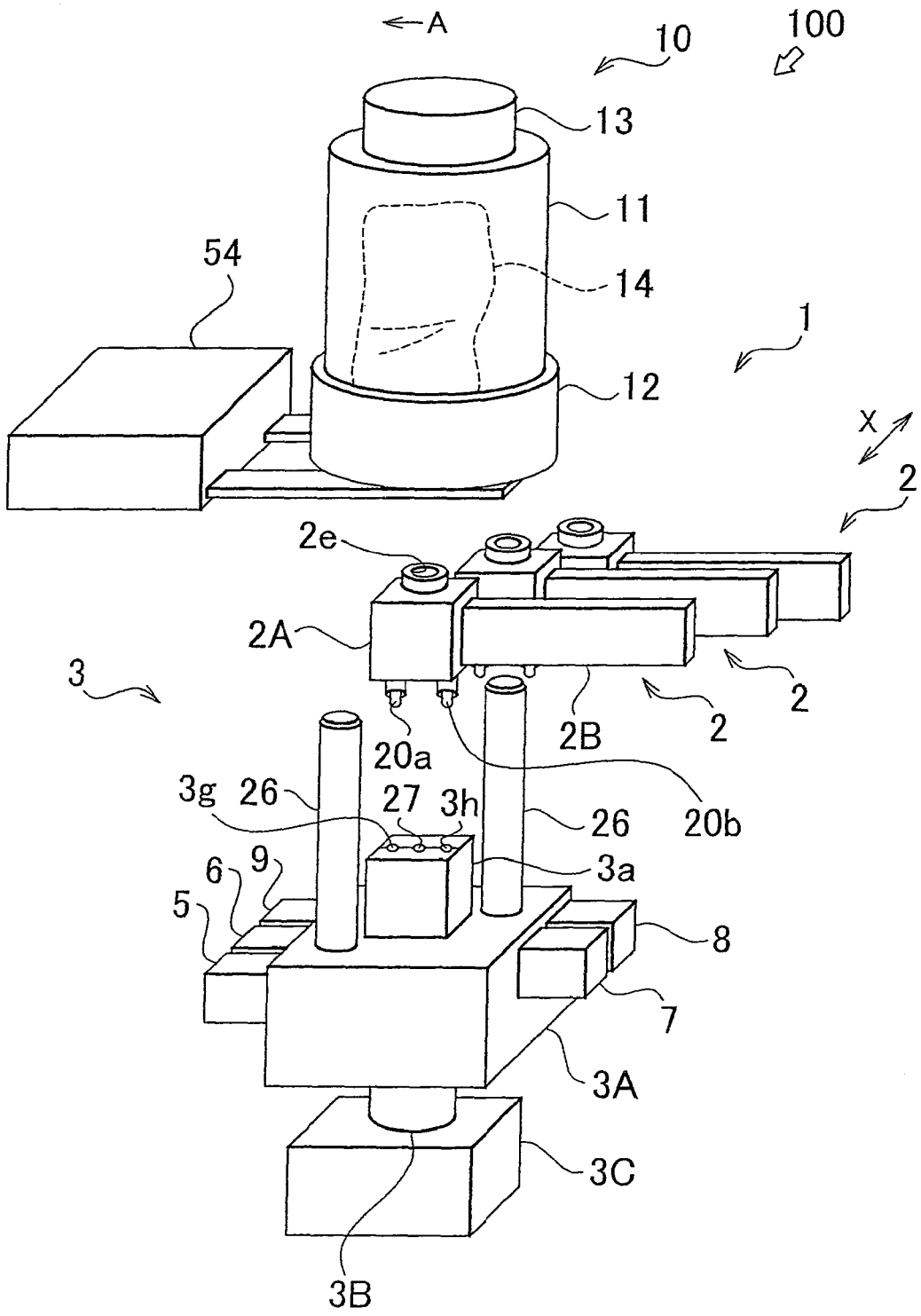
FIGS. 4A and 4B are diagrams showing actions of the paint filling apparatus, and, specifically.
Figure 4B:
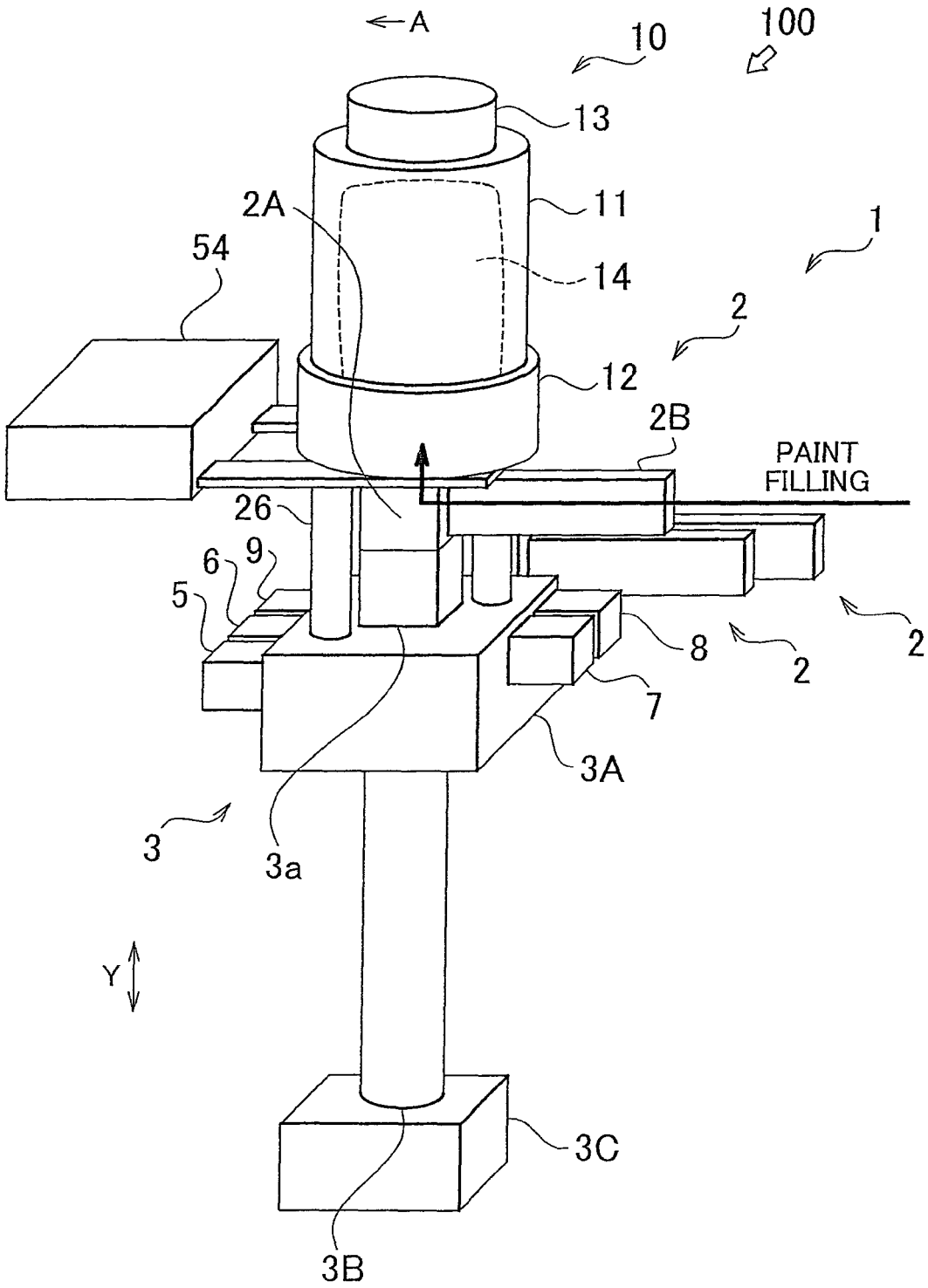

Receiving the command signal, the conveyor device 51 conveys the header portion 2 in a horizontal direction (a direction of an arrow X in FIG. 4A (step S103) until the selected header portion 2 reaches a predetermined position that is located vertically over the common manifold portion 3.

Thus, the paint cartridge 10 and the selected header portion 2 are conveyed to the predetermined positions located vertically over the common manifold portion 3 by the conveyor devices 51 and 54. As a result, the paint filling apparatus 1 has an arrangement as shown in FIG. 4A in which the common manifold portion 3, the selected header portion 2 and the paint cartridge 10 are disposed in that order from bottom to top.

After the paint cartridge 10 and the selected header portion 2 are conveyed to their respective predetermined positions, the control device 50 sends a command signal about the operation to the common manifold portion 3. Receiving the command signal, the common manifold portion 3 activates the actuator 3B, so that the body portion 3A of the common manifold portion 3 ascends (moves in a direction of an arrow Y shown in FIG. 4) (step S104).

In a process regarding the ascent of the body portion 3A of the common manifold portion 3, firstly, the attachment-detachment surface 2*f* in the lower surface of the selected header portion 2 is attached (linked) to an upper surface of the connector portion 3*a* of the common manifold portion 3 (step S105). Subsequently, the support end surface 2*a* of the upper surface of the header portion 2 is attached to the attachment-detachment surface 12*a* of the lower surface of the paint cartridge 10 (step S106), and the two extrusion liquid pipings 26 extending upward from the upper surface of the common manifold portion 3 are linked in communication with the stop valves 19, respectively, that are disposed in the lower surface of the paint cartridge 10 (see FIG. 2).

Then, after the paint cartridge 10, the selected header portion 2 and the common manifold portion 3 are inter-linked as shown in FIG. 4B, the control device 50 sends a command signal to the paint valve 4 (see FIG. 2) such that the paint is filled into the paint cartridge 10 (step S107).

The filling of the paint into the paint cartridge 10 is performed for a predetermined time. After that, the control device 50 sends a command signal to the cleaning liquid valve 5 (see FIG. 2) such that the cleaning liquid is supplied to the attachment-detachment site between the paint cartridge 10 and the header portion 2 (step S108).

The supply of the cleaning liquid is also performed for a predetermined time. After that, the control device 50 sends a command signal to the air valve 6 (see FIG. 2) such that compressed air is supplied to the attachment-detachment site between the paint cartridge 10 and the header portion 2 (step S109).

The supply of compressed air is also performed for a predetermined time. After that, the control device 50 sends a command signal about the operation to the common manifold portion 3. Receiving the command signal, the common manifold portion 3 activates the actuator 3B so that the body portion 3A of the common manifold portion 3 descends (step S110).

Then, during a process related to the descent of the body portion 3A of the common manifold portion 3, the paint cartridge 10 and the header portion 2 separate from each other (step S111). Subsequently, the header portion 2 is placed on the conveyor device 51, and therefore the header portion 2 and the common manifold portion 3 separate from each other (step S112).

Thus, as shown in FIG. 4A, the paint filling apparatus 1 resumes a state assumed prior to the inter-linking of the paint cartridge 10, the selected header portion 2 and the common manifold portion 3. In this manner, the operation of filling the paint into the paint cartridge 10 is completed.

As described above, the paint filling apparatus in this embodiment is the paint filling apparatus 1 that fills the paint cartridge 10 with a color paint that is selected from a plurality of color paints, and has a plurality of header portions 2, and one common manifold portion 3 that is able to supply the cleaning liquid to the header portion 2 to each of the header portions 2. Each header portion 2 is capable of being attached to and detached from the paint cartridge 10, and is also capable of being attached to and detached from the common manifold portion 3. Each header portion 2 is provided with the paint supply channel for filling the paint into the paint cartridge 10, and the paint supply channel is constructed of the piping member 23 and the paint channel 2*b*. An end portion of the paint supply channel of each header portion 2 is linkable in communication with the inside of the paint cartridge 10, and another end portion thereof is linked in communication with a corresponding one of the paint tanks (paint supply sources) 21 that are provided separately for each color of paint. An intermediate portion of the paint supply channel is provided with the paint valve 4 that controls the open-closed state of the upstream side of the paint supply channel.

Thus, since in the paint filling apparatus 1 of this embodiment, the paint supply portions needed separately for each of colors of paints are provided independently, the paint loss can be considerably reduced, in comparison with the case where a common paint cartridge is provided irrespectively of the colors of paints.

That is, in the case where a common connecting portion is provided irrespectively of the colors of paints, an intermediate portion of the foregoing connecting portion is linked in communication with the paint supply sources provided separately for each of the colors of paints, via a supply channel whose intermediate portion has a plurality of branch channels. Therefore, every time the "color changing operation" is performed with regard to the paint to be filled into the paint cartridge 10 in the paint filling apparatus of a comparative example, the entire region in the supply channel from the paint supply source to the connecting portion needs to be cleaned, and the amount of the paint remaining in the supply channel is discharged as a paint loss. In contrast, in the paint filling apparatus 1 of the embodiment, the paint supply portions needed separately for each of the colors of paints are independently provided, so that there is no need to clean the entire region in the supply channel as in the paint filling apparatus of the comparative example, and the paint loss can be significantly reduced.

Besides, in the paint filling apparatus 1 of this embodiment, different paint supply portions can be independently provided separately for each of the colors of paints, and a supply portion related to the cleaning liquid, a discharge portion for the post-cleaning waste liquid, etc., which are commonly needed irrespectively of the color of paint, can be linked together into one unit via the common manifold portion 3. Thus, the apparatus can be made compact as a whole, and therefore the installation space of the paint filling apparatus 1 can be reduced. Besides, the manufacturing cost of the paint filling apparatus 1 can be reduced, which is economically advantageous.

Besides, in the paint filling apparatus 1 of the embodiment, the site of linkage in communication between the paint supply channel (the piping member 23 and the paint channel 2*b*) of each header portion 2 and the inside of the paint cartridge 10, that is, the paint port 2*e*, is provided with the open-close valve 2*g* that controls the open-closed state of the downstream side of the paint supply channel. The site of attachment and detachment of the common manifold portion 3 with respect to each header portion 2, that is, the upper surface of the connector portion 3*a* of the common manifold portion 3, is provided with the trigger valve 27. The trigger valve 27 becomes engaged, via a push rod (not shown), with the open-close valve 2*g* when the common manifold portion 3 and a selected one of the header portions 2 are linked together. In this engaged state, the open-close valve 2*g* performs the opening and closing actions in coordination with the actions of the trigger valve 27.

Due to the foregoing construction, the paint channel 2*b* of each of the header portions 2 always maintains its closed state as long as the paint channel 2*b* is detached from the common manifold portion 3. Therefore, during states other than the state in which the paint cartridge 10, a selected one of the header portions 2 and the common manifold portion 3 are linked with each other in order to fill the paint cartridge 10 with paint, for example, during a state where a selected one of the header portions 2 is being conveyed to a position over the common manifold portion 3 by the conveyor device 51, there is no leakage of paint from the paint channel 2*b*, which is economically advantageous.

Besides, in the paint filling apparatus 1 of the embodiment, the inside of each header portion 2 is provided with the first cleaning liquid channel (the first branch channel) 2*c* and the first waste liquid channel (the second branch channel) 2*d* that are formed near the site of linkage in communication between the paint supply channel (the piping member 23 and the paint channel 2*b*) and the inside of the paint cartridge 10, that is, near the paint port 2*e*. The inside of the common manifold portion 3 is provided with the cleaning liquid supply channel that supplies the cleaning liquid for cleaning the paint port 2*e* (a site of linkage in communication), and the waste liquid discharge channel that discharges the post-cleaning waste liquid to the outside of the paint filling apparatus 1. The cleaning liquid supply channel is constructed of the piping member 28 and the second cleaning liquid channel 3*b*. An end portion of the cleaning liquid supply channel is capable of being linked in communication with the first cleaning liquid channel (the first branch channel) 2*c* in each header portion 2, and another end portion of the cleaning liquid supply channel is linked in communication with the cleaning liquid tank (the cleaning liquid supply source) 34. An intermediate portion of the cleaning liquid supply channel is provide with the cleaning liquid valve 5 that controls the open-closed state of the cleaning liquid supply channel. The waste liquid discharge channel is constructed of the piping member 30 and the second waste liquid channel 3*d*. An end portion of the waste liquid discharge channel is capable of being linked in communication with the first waste channel (the second branch channel) 2*d* in each header portion 2. Another end portion of the waste liquid discharge channel is linked in communication with the waste tank 35. An intermediate portion of the waste liquid discharge channel is provided with the waste liquid control valve 7 that controls the open-closed state of the waste liquid discharge channel.

Figure 5A:
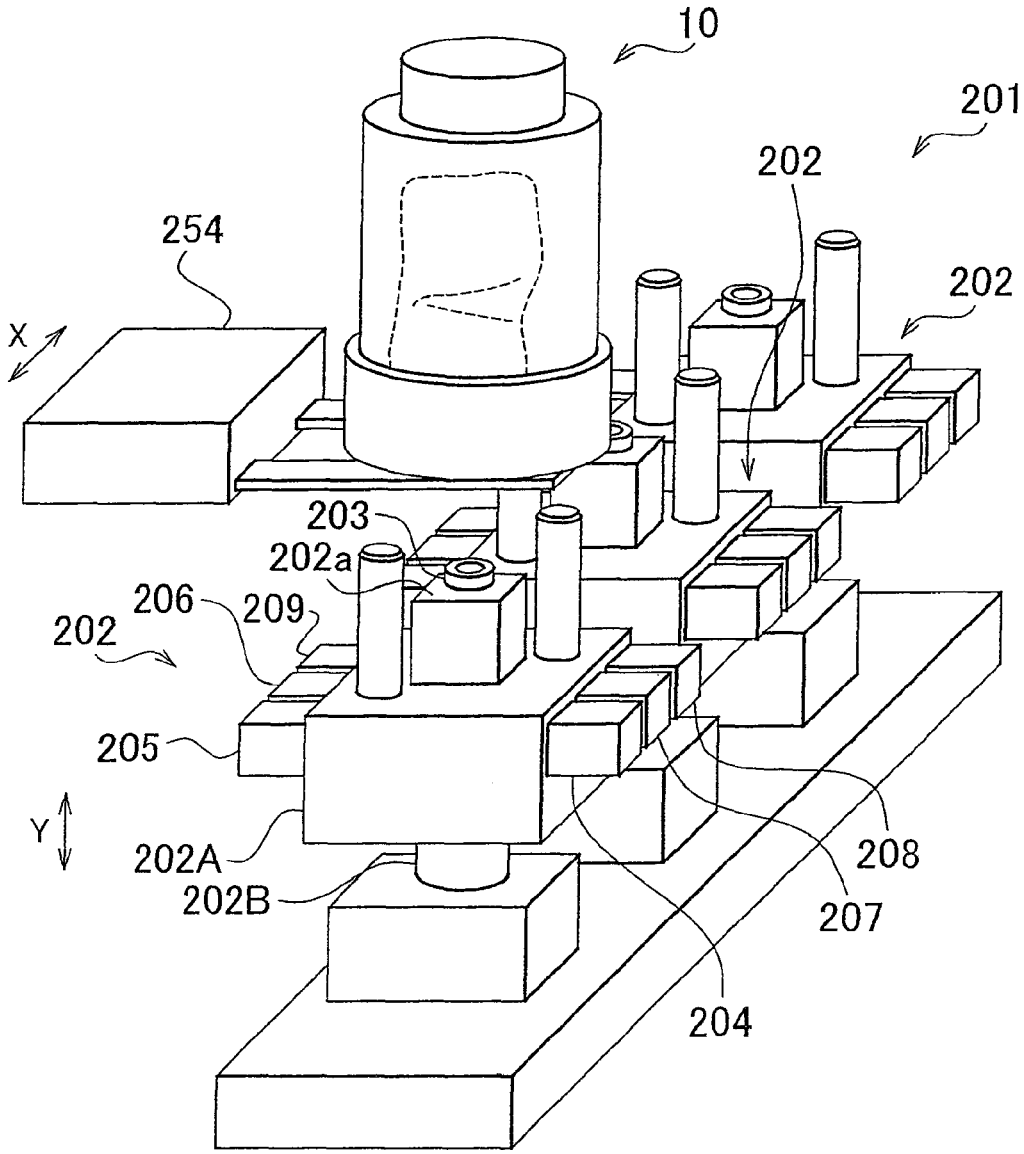
FIGS. 5A and 5B are diagrams showing actions of a paint filling apparatus of a comparative example, and, specifically.
Figure 5B:
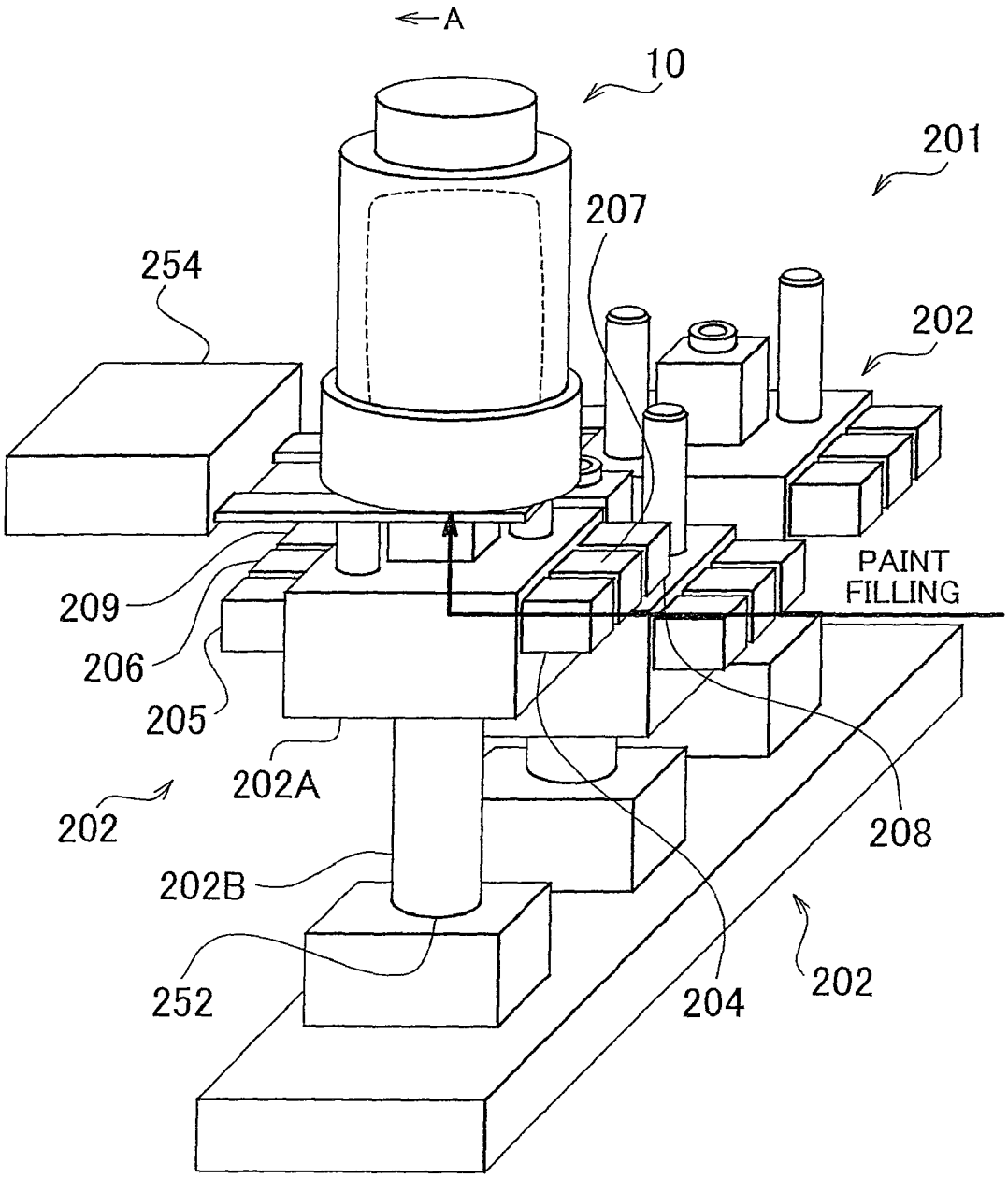

Due to the foregoing construction, it is possible to combine the supply portions related to the cleaning liquid and the waste liquid, which are minimum requirements, at a site via the common manifold portion 3, irrespectively of the color of the paint to be filled into the paint cartridge 10. Therefore, in comparison with the paint filling apparatus 201 of the comparative example in which the supply portions for the cleaning liquid and the waste liquid are provided separately for each of the colors of paints (see FIGS. 5A and 5B), the paint filling apparatus 1 allows a compact construction of the apparatus as a whole, and therefore makes it possible to realize a reduction of the installation space for the apparatus 1 and reduce the manufacturing cost of the paint filling apparatus 1, which is economically advantageous.

Besides, in the paint filling apparatus 1 of the embodiment, the header portion 2 corresponding to the paint of the selected color, which is selected from the plurality of header portions 2, is disposed over the common manifold portion 3, and the paint cartridge 10 is disposed over the header portion 2 that corresponds to the selected paint color. Furthermore, the common manifold portion 3 is provided with the actuator (elongation device) capable of elongation in the vertical direction. By the actuator (elongation device) 3B, the body portion 3A of the common manifold portion 3 is moved upward (raised), so that the common manifold portion 3 as a whole elongates upward. In this manner, the paint cartridge 10, the header portion 2 corresponding to the selected paint color, and the common manifold portion 3 become linked together.

Due to the foregoing construction, the paint cartridge 10 and the header portions 2 are free from the need for an external linkage device or the like. That is, the common manifold portion 3 provided with the actuator 52 performs the function of a linkage device related to the linkage of the paint cartridge 10 and each header portion 2. Therefore, the paint filling apparatus 1 can be made compact in construction, so that reduction of the installation space for the paint filling apparatus 1 can be realized, and the manufacturing cost of the paint filling apparatus 1 can be reduced, which is economically advantageous.

The invention claimed is:

1. A paint filling apparatus that fills a paint cartridge with a paint of a color selected from a plurality of color paints, comprising:

a plurality of header portions; and one common manifold portion that is able to supply a cleaning liquid to each of the header portions, wherein:

one side of each of the header portions is attachable to and detachable from the paint cartridge, and another side of each header portion is attachable to and detachable from the common manifold portion;

each header portion is provided with a paint supply channel configured to fill the paint into the paint cartridge independent of the common manifold portion;

one end portion of the paint supply channel of each header portion is linkable in communication with an inside of the paint cartridge, and another end portion of each paint supply channel is linked in communication with a corresponding one of a plurality of paint supply sources that are provided separately for each of the colors of the paints; and an intermediate portion of each paint supply channel is provided with a paint valve that controls an open-closed state of an upstream side of the paint supply channel.

2. A paint filling apparatus that fills a paint cartridge with a paint of a color selected from a plurality of color paints, comprising:

a plurality of header portions; and one common manifold portion that is able to supply a cleaning liquid to each of the header portions, wherein:

one side of each of the header portions is attachable to and detachable from the paint cartridge, and another side of each header portion is attachable to and detachable from the common manifold portion;

each header portion is provided with a paint supply channel without involving the common manifold portion for filling the paint into the paint cartridge;

one end portion of the paint supply channel of each header portion is linkable in communication with an inside of the paint cartridge, and another end portion of each paint supply channel is linked in communication with a corresponding one of a plurality of paint supply sources that are provided separately for each of the colors of the paints; and an intermediate portion of each paint supply channel is provided with a paint valve that controls an open-closed state of an upstream side of the paint supply channel, wherein a site of linkage in communication of the paint supply channel of each header portion with respect to the inside of the paint cartridge is provided with an open-close valve that controls the open-closed state of a downstream side of the paint supply channel, a site of attachment and detachment of the common manifold portion with respect to each header portion is provided with a trigger valve, the trigger valve becomes engaged with the open-close valve of a selected one of the header portions as the selected header portion and the common manifold portion are linked, and the open-close valve performs opening and closing actions in coordination with actions of the trigger valve.

3. A paint filling apparatus that fills a paint cartridge with a paint of a color selected from a plurality of color paints, comprising:

a plurality of header portions; and one common manifold portion that is able to supply a cleaning liquid to each of the header portions, wherein:

one side of each of the header portions is attachable to and detachable from the paint cartridge, and another side of each header portion is attachable to and detachable from the common manifold portion;

each header portion is provided with a paint supply channel without involving the common manifold portion for filling the paint into the paint cartridge;

one end portion of the paint supply channel of each header portion is linkable in communication with an inside of the paint cartridge, and another end portion of each paint supply channel is linked in communication with a corresponding one of a plurality of paint supply sources that are provided separately for each of the colors of the paints; and an intermediate portion of each paint supply channel is provided with a paint valve that controls an open-closed state of an upstream side of the paint supply channel, wherein within each header portion, a first branch channel and a second branch channel are provided near a site of linkage in communication of the paint supply channel with respect to the inside of the paint cartridge, within the common manifold portion, a cleaning liquid supply channel that supplies a cleaning liquid for cleaning the site of linkage in communication, and a waste liquid discharge channel for discharging a post-cleaning waste liquid to an outside of the paint filling apparatus are provided, one end portion of the cleaning liquid supply channel is linkable in communication with the first branch channel provided in each header portion, and another end portion of the cleaning liquid supply channel is linked in communication with the cleaning liquid supply source, an intermediate portion of the cleaning liquid supply channel is provided with a cleaning liquid valve that controls the open-closed state of the cleaning liquid supply channel, one end portion of the waste liquid discharge channel is linkable in communication with the second branch channel provided in each header portion, and another end portion of the waste liquid discharge channel is linked in communication with a waste liquid tank, and an intermediate portion of the waste liquid discharge channel is provided with a waste liquid valve that controls the open-closed state of the waste liquid discharge channel.

4. A paint filling apparatus that fills a paint cartridge with a paint of a color selected from a plurality of color paints, comprising:

a plurality of header portions; and one common manifold portion that is able to supply a cleaning liquid to each of the header portions, wherein:

one side of each of the header portions is attachable to and detachable from the paint cartridge, and another side of each header portion is attachable to and detachable from the common manifold portion;

each header portion is provided with a paint supply channel without involving the common manifold portion for filling the paint into the paint cartridge;

one end portion of the paint supply channel of each header portion is linkable in communication with an inside of the paint cartridge, and another end portion of each paint supply channel is linked in communication with a corresponding one of a plurality of paint supply sources that are provided separately for each of the colors of the paints; and an intermediate portion of each paint supply channel is provided with a paint valve that controls an open-closed state of an upstream side of the paint supply channel, wherein among the plurality of header portions, the header portion corresponding to the paint of the selected color is disposed above the common manifold portion, the paint cartridge is disposed above the header portion that corresponds to the paint of the selected color, the common manifold portion has an elongation device capable of elongation in an up down direction, and the elongation device elongates the common manifold portion upward, and interlinks the common manifold portion, the paint cartridge and the header portion that corresponds to the paint of the selected color.

* * * * *